US008979474B2

(12) United States Patent
Hoji

(10) Patent No.: US 8,979,474 B2
(45) Date of Patent: Mar. 17, 2015

(54) VARIABLE FLOW RATE PUMP

(75) Inventor: Takeshi Hoji, Tokyo (JP)

(73) Assignee: TBK Co., Ltd., Tokyo (JP)

( * ) Notice: Subject to any disclaimer, the term of this patent is extended or adjusted under 35 U.S.C. 154(b) by 677 days.

(21) Appl. No.: 13/376,571

(22) PCT Filed: Jun. 25, 2009

(86) PCT No.: PCT/JP2009/061598
§ 371 (c)(1),
(2), (4) Date: Dec. 6, 2011

(87) PCT Pub. No.: WO2010/150379
PCT Pub. Date: Dec. 29, 2010

(65) Prior Publication Data

US 2012/0076637 A1 Mar. 29, 2012

(51) Int. Cl.

| | |
|---|---|
| ***F04D 29/44*** | (2006.01) |
| ***F01D 19/02*** | (2006.01) |
| ***F04D 29/42*** | (2006.01) |
| ***F01P 7/16*** | (2006.01) |
| ***F04D 15/00*** | (2006.01) |

(52) U.S. Cl.
CPC ..... *F04D 29/426* (2013.01); *F01P 7/161* (2013.01); *F04D 15/0038* (2013.01)
USPC ..... 415/47; 415/204; 415/206; 415/207

(58) Field of Classification Search
CPC ... F04D 29/584; F04D 29/588; F04D 29/426; F04D 29/4246; F04D 15/0038; F01P 7/161; F01P 7/162
USPC ..... 415/49, 47, 207, 911
See application file for complete search history.

(56) References Cited

U.S. PATENT DOCUMENTS

| | | | | |
|---|---|---|---|---|
| 2,306,951 | A * | 12/1942 | Jennings | 415/128 |
| 5,299,630 | A * | 4/1994 | Schatz | 165/10 |
| 5,540,567 | A * | 7/1996 | Schirpke et al. | 417/369 |
| 6,712,028 | B1 * | 3/2004 | Robbins et al. | 123/41.08 |
| 6,880,498 | B2 * | 4/2005 | Suzuki et al. | 123/41.14 |

FOREIGN PATENT DOCUMENTS

| | | |
|---|---|---|
| JP | 40-009667 | 5/1965 |
| JP | 55-130014 | 9/1980 |
| JP | 56-111294 | 8/1981 |
| JP | 11-336549 | 12/1999 |

OTHER PUBLICATIONS

International Search Report; PCT/JP2009/061598; Oct. 6, 2009.

* cited by examiner

*Primary Examiner* — Edward Look
*Assistant Examiner* — Michael Sehn
(74) *Attorney, Agent, or Firm* — Studebaker & Brackett PC

(57) ABSTRACT

A water pump (30) includes an impeller chamber (32) formed in a housing (31), a swirl chamber (40) formed in the housing (31) to communicate with a coolant passage (8) and the impeller chamber (32), and an impeller (33) that is supported to be free to rotate in the impeller chamber (32) and rotates in conjunction with an engine (2) so as to take in a coolant and discharge the coolant into the coolant passage (8) via the swirl chamber (40). The swirl chamber (40) is formed to be divided into a first swirl chamber (41) that communicates with the coolant passage (8) at all times, and a second swirl chamber (42) and a third swirl chamber (43) respectively connected to the coolant passage (8) via thermostats (S1, S2) respectively having switch valves that can be opened and closed. The thermostats (S1, S2) are operated to open and close, thereby connecting and cutting off the swirl chambers (42, 43) and the coolant passage (8), in accordance with a temperature of the coolant.

2 Claims, 4 Drawing Sheets

VARIABLE FLOW RATE PUMP

TECHNICAL FIELD

The present invention relates to a variable flow rate pump represented by a water pump or the like, for example, that circulates a coolant through an engine.

TECHNICAL BACKGROUND

A water pump is used conventionally in a cooling device for a water-cooled engine installed in a vehicle or the like, and a cooling performance of the engine is closely related to a flow rate of a coolant circulated by the water pump. This type of cooling device is constituted by a coolant passage including a water jacket, which is provided in an engine main body, and a radiator, a thermostat, the aforesaid water pump, and so on, which are connected to the coolant passage. In this type of cooling device, the water pump is operated when the engine is driven to circulate the coolant through the coolant passage. As the coolant flows through the water jacket, heat exchange is performed with an engine main body, and as a result, the engine is cooled (see Patent Document 1, for example).

PRIOR ARTS LIST

Patent Document

Patent Document 1: Japanese Laid-Open Patent Publication No. H11-336549(A)

SUMMARY OF THE INVENTION

Problems to be Solved by the Invention

Incidentally, in an engine cooling device, the engine must be cooled when warm using the coolant circulated by the water pump in order to suppress burning, friction, and so on in the engine. During engine startup from a cold condition, on the other hand, the engine must be warmed quickly from the cold condition, in which thermal efficiency is poor. In a conventional water pump that operates in conjunction with driving of the engine, when a pump rotation speed is maintained at a fixed speed at this time, the coolant is discharged at a fixed flow rate corresponding to a volume of a pump swirl chamber or the like, regardless of a temperature of the circulating coolant. Therefore, during an engine warm-up operation, a discharge flow rate of the water pump increases gradually as the pump rotation speed of the water pump rises in conjunction with the engine such that when the pump rotation speed is maintained at a fixed speed thereafter, the coolant supplied to the engine is likewise discharged at a fixed flow rate (a maximum flow rate) corresponding to a pump capacity, regardless of variation in the temperature of the coolant. As a result, the engine may be cooled, leading to friction and so on in the engine interior and an increase in an amount of $CO_2$ discharged in exhaust gas due to a reduction in thermal efficiency.

The present invention has been designed in consideration of this problem, and an object thereof is to provide a variable flow rate pump with which an improvement in a warm-up performance of an engine can be achieved.

Means to Solve the Problems

To solve the problem described above, a variable flow rate pump (a water pump 30 according to an embodiment, for example) according to the present invention is provided in a coolant circulation passage to take in a coolant from a suction passage (a coolant passage 7 according to an embodiment, for example) of the circulation passage and supply the coolant to a discharge passage (a coolant passage 8 according to an embodiment, for example), and includes: a housing; an impeller chamber formed in the housing to communicate with the suction passage; a swirl chamber formed in the housing to communicate with the discharge passage and the impeller chamber; an impeller supported to be free to rotate in the impeller chamber so as to take in the coolant from the suction passage and discharge the coolant into the discharge passage via the swirl chamber while rotating; and driving means (an engine 2 according to an embodiment, for example) for rotating the impeller. The swirl chamber is formed to be divided into a main swirl chamber (a first swirl chamber 41 according to an embodiment, for example) that communicates with the discharge passage at all times and a secondary swirl chamber (a second swirl chamber 42 according to an embodiment, for example) that is connected to the discharge passage via a thermostat having a switch valve that can be opened and closed. The thermostat is operated to open and close, thereby connecting and cutting off the secondary swirl chamber and the discharge passage, in accordance with a temperature of coolant delivered from the secondary swirl chamber.

In the variable flow rate pump configured as described above, the secondary swirl chamber is preferably further divided to form a plurality of divided swirl chambers (the second swirl chamber 42 and a third swirl chamber 43 according to an embodiment, for example), a plurality of thermostats respectively having switch valves that can be opened and closed to connect and cut off the plurality of divided swirl chambers and the discharge passage in accordance with the temperature of the coolant are preferably disposed between the plurality of divided swirl chambers and the discharge passage, and sensitive temperatures of the plurality of thermostats for connecting and cutting off the plurality of divided swirl chambers and the discharge passage are preferably set at respectively different temperatures.

Further, a volume of the main swirl chamber is preferably formed to be smaller than a volume of each of the divided swirl chambers.

Advantageous Effects of the Invention

With the variable flow rate pump according to the present invention, when the engine is started from a cold condition, coolant is supplied to the engine at a small flow rate only from the main swirl chamber that communicates with the engine at all times, and therefore warm-up of the engine can be promoted while suppressing a thermal load such that the engine can be warmed quickly. When the engine is warm, on the other hand, the thermostat connects the secondary swirl chamber and the discharge passage by a valve opening corresponding to the temperature of the circulating coolant such that coolant is supplied to the engine from the secondary swirl chamber in addition to the coolant from the constantly communicative main swirl chamber. As a result, a sufficient engine cooling effect can be exhibited by the coolant having the increased flow rate, leading to a reduction in friction in the engine interior and a corresponding improvement in fuel efficiency. Moreover, an improvement in the thermal efficiency of the engine can be achieved, enabling a reduction in the amount of $CO_2$ discharged from the engine in the exhaust gas.

In the inventions described above, by further dividing the secondary swirl chamber into the plurality of divided swirl chambers and setting the sensitive temperatures of the plurality of thermostats for connecting and cutting off the plurality of divided swirl chambers and the discharge passage at respectively different temperatures, a pump discharge flow rate can be controlled more finely in response to variation in the temperature of the coolant. Further, by adjusting the discharge flow rate in steps in accordance with variation in the temperature of the coolant, coolant discharge at a flow rate exceeding a required flow rate of the engine can be prevented. As a result, a workload of the water pump can be prevented from becoming excessive, and energy loss can be reduced.

Furthermore, in the inventions described above, by forming the volume of the main swirl chamber to be smaller than the volume of the divided swirl chambers, the coolant can be supplied to the engine at a small flow rate when the engine is started from a cold condition, and therefore an engine warm-up time can be reduced even further. When the engine is warm, on the other hand, the coolant can be supplied to the engine at a larger flow rate, and therefore the engine cooling effect can be improved even further such that overheating and the like can be prevented.

BRIEF DESCRIPTION OF THE DRAWINGS

FIG. 3 is a pattern diagram showing operation conditions of the variable flow rate pump corresponding to variation in a temperature of a coolant, wherein

DESCRIPTION OF THE EMBODIMENTS

Figure 1:
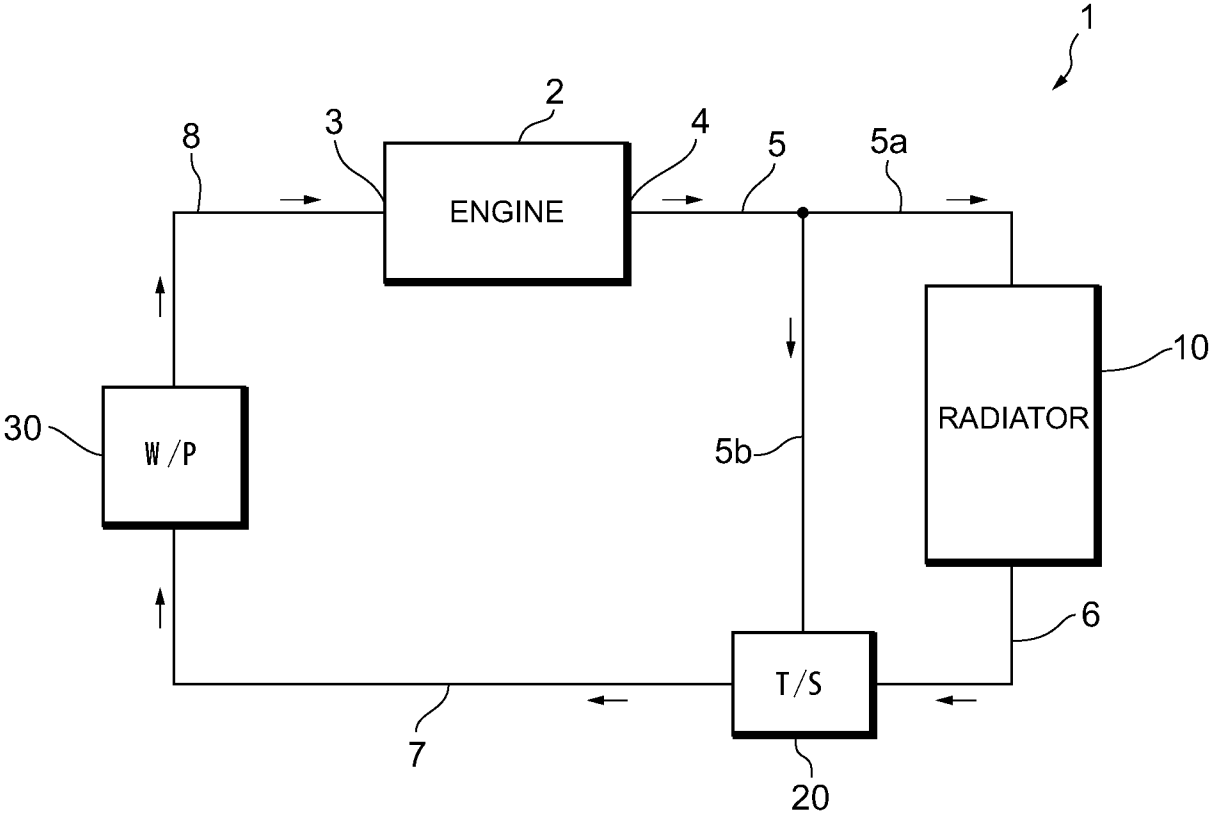
FIG. 1 is a schematic diagram showing an engine cooling device including a variable flow rate pump according to an embodiment of the present invention.

A preferred embodiment of the present invention will be described below with reference to the drawings. In this embodiment, a variable flow rate pump is disposed on a coolant circulation path of an engine, but before describing the variable flow rate pump according to this embodiment, an engine cooling device to which the variable flow rate pump is applied will be described using FIG. 1.

An engine cooling device 1 is constituted mainly by an engine 2 formed from a water-cooled internal combustion engine, a radiator 10 for cooling a coolant serving as an engine cooling medium when the coolant is discharged from the engine 2, a thermostat 20 for controlling circulation of the coolant in accordance with a temperature of the coolant, and a variable flow rate pump (to be referred to in the following description as a "water pump") 30 for forcibly circulating the coolant. The engine cooling device 1 cools the engine 2 by circulating the coolant through coolant passages 5 (5*a*, 5*b*), 6, 7, 8 connecting the components described above. Note that in FIG. 1, a flow of the coolant flowing through the coolant passages 5 to 8 is indicated by solid line arrows.

The engine 2 is a water-cooled gasoline engine, for example, and a water jacket (not shown) is provided in the interior thereof as a space formed to cover a cylinder (not shown). The coolant is caused to flow into the water jacket through a coolant introduction port 3, performs heat exchange with the cylinder and so on while passing through the water jacket, and is then discharged from a coolant discharge port 4.

The radiator 10 is connected to the coolant discharge port 4 of the engine 2 via the coolant passage 5 (5*a*), and is configured to cool the coolant passing through the interior thereof by blowing air from an electric fan, not shown in the drawing, such that heat is released to the outside. Hence, a temperature of the coolant, which was raised in the water jacket of the engine 2, is lowered by heat radiation as the coolant passes through the radiator 10.

The thermostat 20 is connected to the radiator 10 via the coolant passage 6 and connected to the coolant passage 5*b*, which is formed as a bypass passage that bifurcates from the coolant passage 5 so as to bypass the radiator 10. The thermostat 20 is constituted by a coolant-sensitive switch valve that opens and closes in accordance with the temperature of the coolant. Accordingly, when the temperature of the coolant is equal to or lower than a predetermined temperature, the coolant passage (the bypass passage) 5*b* communicates with the coolant passage 7, and when the temperature of the coolant exceeds the predetermined temperature, the coolant passage 6 communicates with the coolant passage 7.

The water pump 30 is connected to the thermostat 20 via the coolant passage 7, and a pump rotary shaft thereof is drive-coupled to a crankshaft (not shown) of the engine 2 via a pulley, a belt, and so on. Thus, the water pump 30 operates in conjunction with driving of the engine 2. The coolant passage 8 is connected to a discharge port of the water pump 30 such that the coolant discharged from the water pump 30 is supplied to the water jacket from the coolant introduction port 3 of the engine 2 through the coolant passage 8.

In the engine cooling device thus configured, the coolant discharged from the water pump 30 flows into the water jacket formed in the interior of the engine 2, cools the engine 2, and is then discharged to the outside. The discharged coolant is either cooled by the radiator 10 or caused to flow into the thermostat 20 via the bypass passage 5*b* without passing through the radiator 10, and then returned to the water pump 30 to be circulated.

In the engine cooling device 1 described above, the engine 2 must be cooled when warm to suppress burning, friction, and so on in the engine 2. When the engine 2 is started up from a cold condition, on the other hand, the engine 2 must be warmed quickly from the cold condition, in which thermal efficiency is poor. In a conventional water pump, however, a discharge flow rate increases as a pump rotation speed rises, and when the pump rotation speed is maintained at a fixed speed, the coolant is discharged at a fixed flow rate corresponding to a volume of a swirl chamber or the like, regardless of variation in the temperature of the coolant. Therefore, when an engine rotation speed increases during a warm-up operation in the engine 2, the rotation speed of the pump rotary shaft (an impeller) of the water pump 30, which operates in conjunction with the engine 2 via the crankshaft and so on, also increases, leading to an increase in the flow rate of the coolant supplied to the engine 2. When the pump rotation speed is maintained at a fixed speed, the coolant supplied to the engine is discharged at a fixed flow rate (a maximum flow rate) corresponding to a pump capacity, regardless of variation in the temperature of the coolant, and as a result, the engine 2 is cooled, thereby impairing the warm-up operation.

Hence, in the water pump 30 according to this embodiment, the discharge flow rate of the coolant supplied to the engine 2 is controlled variably in accordance with the temperature of the circulating coolant. The constitution of the water pump 30 will now be described with additional reference to FIGS. 2 and 3. Note that FIG. 2 is a sectional view showing the main parts of the water pump 30, and FIG. 3 is a pattern diagram showing operation conditions of the water pump 30 corresponding to variation in the temperature of the coolant.

Figure 2:
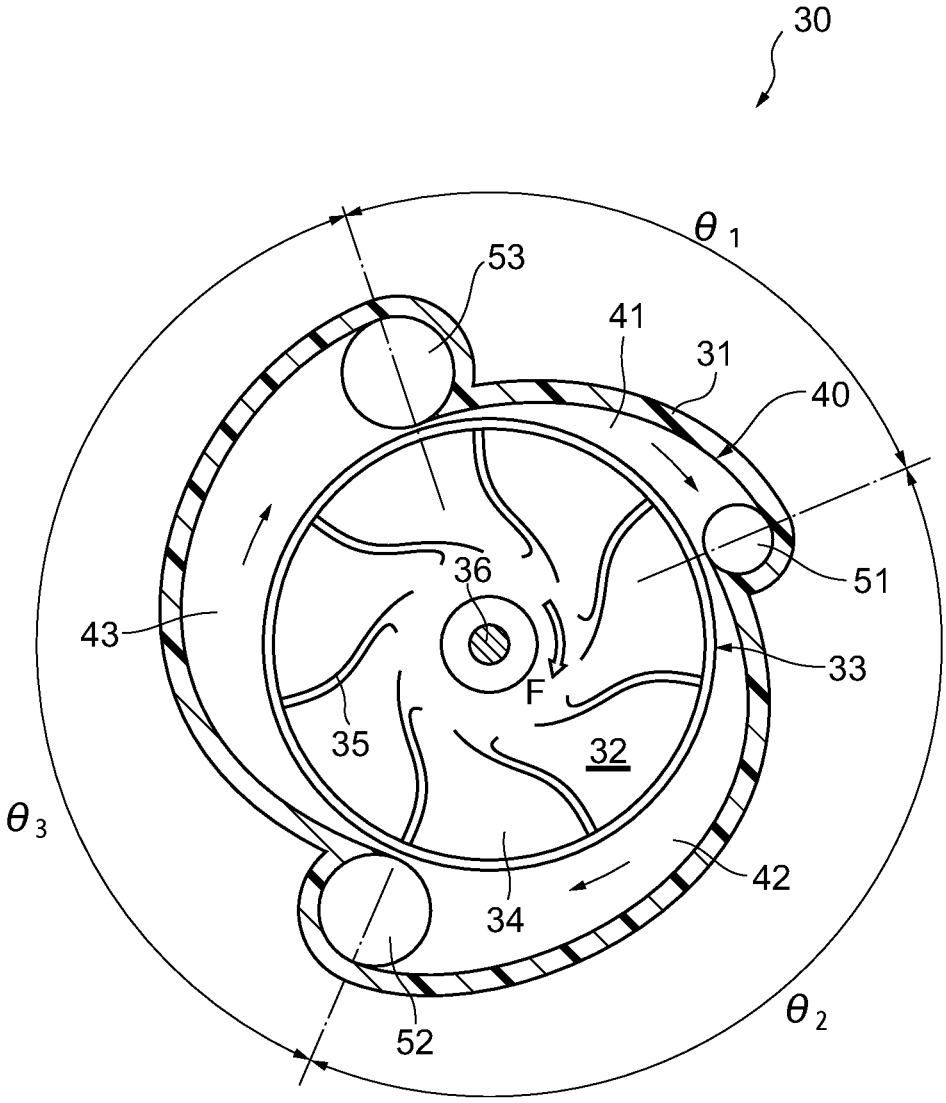
FIG. 2 is a sectional view showing the main parts of the variable flow rate pump.

As shown in FIG. 2, the water pump 30 is mainly constituted by an impeller chamber 32 formed in a housing 31, a swirl chamber 40 formed in the housing 31 on an outer peripheral side of the impeller chamber 32 and divided into three chambers, and an impeller 33 attached to the impeller chamber 32 to be free to rotate.

The impeller 33 includes a base plate portion 34 formed in an annular plate shape, and a plurality of vanes 35 formed to project at equal intervals on one side face of the base plate portion 34, and is configured to be capable of rotating in a rotation direction F (a clockwise direction) about a pump rotary shaft 36, which is drive-coupled to the crankshaft (not shown) of the engine 2 via a pulley, a belt, and so on.

A suction passage (not shown) that communicates with the coolant passage 7 is connected to a central portion of the impeller chamber 32, and the impeller chamber 32 receives a centrifugal force generated when the impeller 33 rotates such that the coolant flowing through the coolant passage 7 is suctioned therein through the suction passage.

The swirl chamber 40 is constituted by three swirl chambers, namely a first swirl chamber 41, a second swirl chamber 42, and a third swirl chamber 43, which are disposed at intervals in a circumferential direction on the outer peripheral side of the impeller chamber 32. In other words, rather than being formed in an integral ring shape around the entire circumference of the outer peripheral side of the impeller chamber 32, as in the related art, the swirl chamber 40 is divided into three chambers on the outer peripheral side of the impeller chamber 32 in the circumferential direction in respective ranges of angles $\theta_1$, $\theta_2$, $\theta_3$.

The first swirl chamber 41 opens onto the outer peripheral side of the impeller chamber 32 on an inner peripheral side thereof such that coolant delivered outwardly in a radial direction from the impeller 33 can flow therein over a circumferential direction range of the angle $\theta_1$, and a first discharge port 51 serving as an outlet for the inflowing coolant is provided in a terminal end portion thereof so as to communicate with the coolant passage 8 at all times. Hence, the coolant that is delivered into the first swirl chamber 41 is discharged from the first discharge port 51 of the first swirl chamber 41 constantly as the impeller 33 rotates.

The second swirl chamber 42 opens onto the outer peripheral side of the impeller chamber 32 on an inner peripheral side thereof such that the coolant delivered outwardly in the radial direction from the impeller 33 can flow therein over a circumferential direction range of the angle $\theta_2$ ($\theta_2>\theta_1$), and a second discharge port 52 serving as an outlet for the inflowing coolant is provided in a terminal end portion thereof so as to communicate with the coolant passage 8.

Further, a thermostat S1 that connects and cuts off the second discharge port 52 and the coolant passage 8 is connected between the second discharge port 52 and the coolant passage 8. The thermostat S1 is constituted by a coolant-sensitive switch valve that opens and closes in accordance with the temperature of the coolant discharged from the second discharge port 52. When the temperature of the coolant is equal to or lower than a predetermined first temperature T1 (60° C., for example), the thermostat S1 closes, thereby completely cutting off the second discharge port 52 from the coolant passage 8, and when the coolant temperature exceeds the first temperature T1, the thermostat S1 begins to open such that the second discharge port 52 communicates with the coolant passage 8 and the coolant introduced into the second swirl chamber 41 is discharged from the second discharge port 52 at a flow rate corresponding to a valve opening. When the temperature of the coolant reaches a predetermined second temperature T2 (70° C., for example), the thermostat S1 enters a fully open condition.

The third swirl chamber 43 opens onto the outer peripheral side of the impeller chamber 32 on an inner peripheral side thereof such that the coolant delivered outwardly in the radial direction from the impeller 33 can flow therein over a circumferential direction range of the angle $\theta_3$ ($\theta_3>\theta_1$), and a third discharge port 53 serving as an outlet for the inflowing coolant is provided in a terminal end portion thereof so as to communicate with the coolant passage 8.

Further, a thermostat S2 that connects and cuts off the third discharge port 53 and the coolant passage 8 is connected between the third discharge port 53 and the coolant passage 8. The thermostat S2 is constituted by a coolant-sensitive switch valve that opens and closes in accordance with the temperature of the coolant discharged from the third discharge port 53. When the temperature of the coolant is equal to or lower than a predetermined third temperature T3 (75° C., for example), the thermostat S2 closes, thereby completely cutting off the third discharge port 53 from the coolant passage 8, and when the coolant temperature exceeds the third temperature T3, the thermostat S2 begins to open such that the third discharge port 53 communicates with the coolant passage 8 and the coolant introduced into the third swirl chamber 43 is discharged from the third discharge port 53 at a flow rate corresponding to the valve opening. When the temperature of the coolant reaches a predetermined fourth temperature T4 (85° C., for example), the thermostat S2 enters a fully open condition, and at this point, the flow rate of the coolant discharged from the respective discharge ports 51, 52, 53 of the water pump 30 reaches a maximum.

The water pump 30 configured as described above introduces the coolant delivered into the respective swirl chambers 41, 42, 43 by the centrifugal force generated when the impeller 33 rotates into the engine 2 at a discharge flow rate corresponding to the temperature of the coolant. In other words, the water pump 30 varies a volume by which the swirl chamber communicates with the coolant passage 8 by switching between a condition in which the coolant passage 8 communicates with the first swirl chamber 41, a condition in which the coolant passage 8 communicates with the first and second swirl chambers 41, 42, and a condition in which the coolant passage 8 communicates with the respective swirl chambers 41, 42, 43 in accordance with the temperature of the coolant at a fixed pump rotation speed. Thus, the water pump 30 variably controls the discharge flow rate of the coolant supplied to the engine 2.

Figure 4:
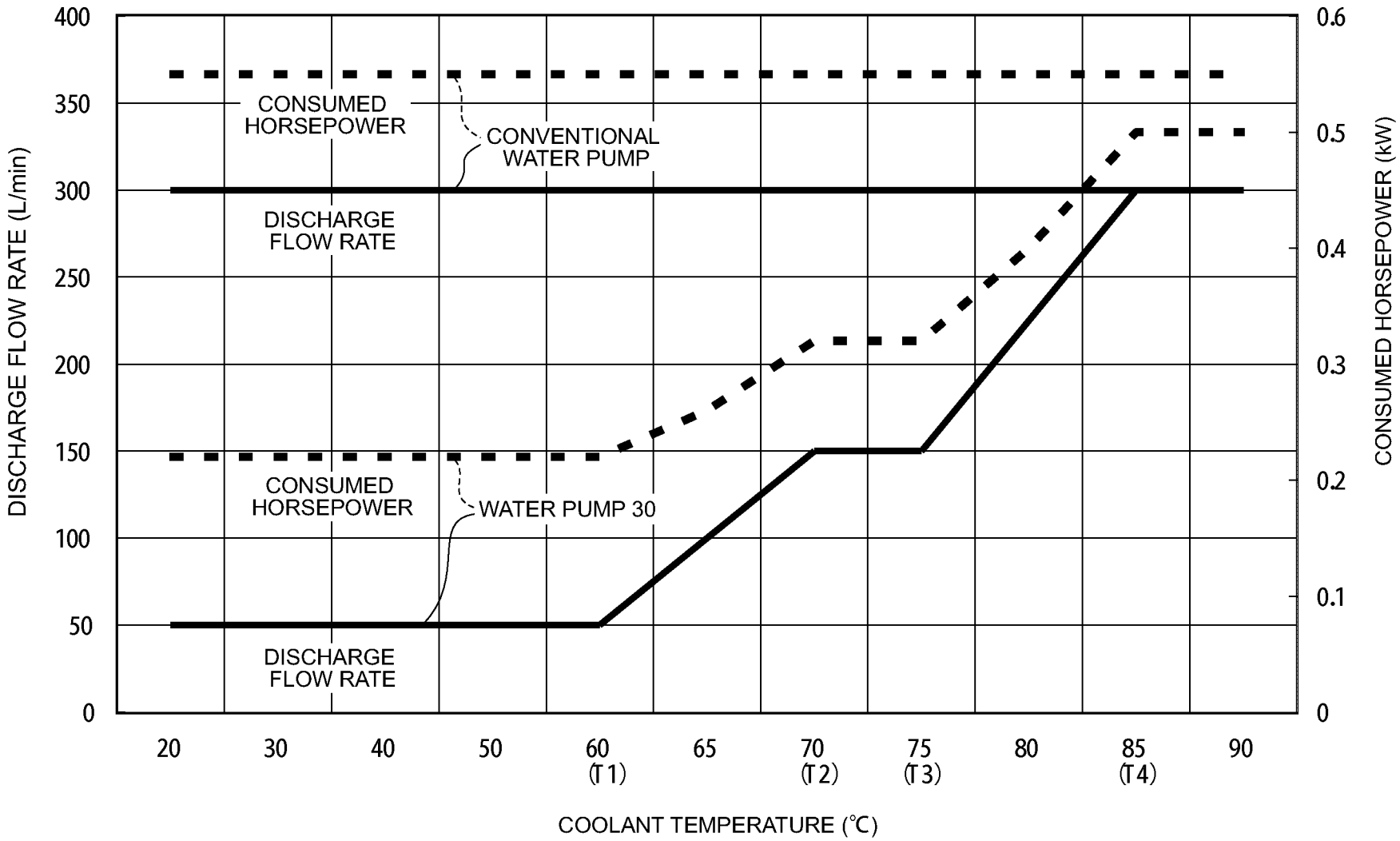
FIG. 4 is a graph comparing the variable flow rate pump with a conventional normal pump in terms of a relationship of the coolant temperature to a pump discharge flow rate and a pump workload (a consumed horsepower) at a fixed pump rotation speed.

Next, an operation of the water pump 30 having the above constitution will be described with additional reference to FIG. 4. FIG. 4 is a graph comparing the water pump 30 according to this embodiment with a conventional water pump (a normal pump) in terms of a relationship of the coolant temperature to the pump discharge flow rate and a pump workload (a consumed horsepower) at a fixed pump rotation speed (2000 rpm). Note that in the drawing, solid lines indicate the discharge flow rate relative to the coolant temperature, while dotted lines indicate the consumed horsepower relative to the coolant temperature. Further, here, the fourth temperature T4 (85° C.) is set as an appropriate cooling temperature of the engine 2.

When the pump rotation speed is maintained at the fixed speed (2000 rpm) in the conventional water pump at this time, the discharge flow rate and the workload are held at fixed levels at all times, regardless of variation in the temperature of the coolant. As a result, the warm-up performed while the engine is cold, as described above, is impaired, and even when an engine load is small such that a heat balance is maintained, the coolant may be supplied at a greater flow rate than necessary such that an excessive workload (engine driving force) is used. In the water pump 30, on the other hand, as shown in FIG. 4, the discharge flow rate and the workload are adjusted in accordance with variation in the temperature of the coolant, even when the pump rotation speed is maintained at the fixed speed (2000 rpm). This operation will now be described more specifically.

Figure 3A:
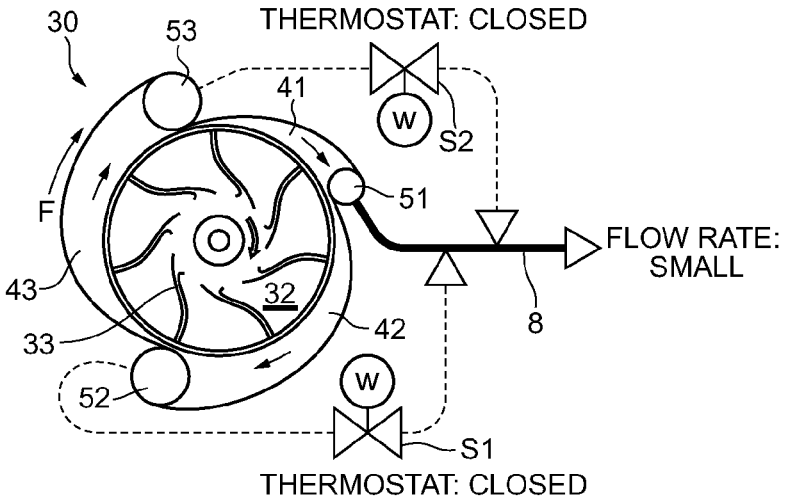
FIG. 3A shows a condition during cold startup.

When the engine 2 is started in a vehicle, for example, the impeller 33 of the water pump 30 rotates in the rotation direction F (the clockwise direction) about the pump rotary shaft 36 drive-coupled to the crankshaft (not shown) of the engine 2 via a pulley, a belt, and so on. When the engine 2 is started up from a cold condition at this time, the coolant temperature is low, and therefore the thermostats S1, S2 are both closed, as shown in FIG. 3A, such that only the first discharge port 51 communicates with the coolant passage 8 for introducing the coolant into the engine 2 while the second and third discharge ports 52, 53 are cut off from the coolant passage 8. Accordingly, the coolant that is suctioned into the impeller chamber 32 from the suction passage by the centrifugal force generated as the impeller 33 rotates is delivered into the respective swirl chambers 41, 42, 43 by the impeller 33, whereupon only the coolant delivered into the first swirl chamber 41 is discharged through the first discharge port 51 at a flow rate corresponding to the volume of the swirl chamber and supplied to the engine 2 through the coolant passage 8.

Hence, when the engine 2 is started up from a cold condition, coolant is supplied to the engine 2 at a small flow rate only from the first swirl chamber 41 having a small volume, and therefore an engine cooling effect is suppressed (warm-up of the engine 2 is promoted). Hence, in comparison with a conventional water pump configured such that coolant is discharged from a swirl chamber formed integrally around the entire outer periphery (360°) of the impeller chamber in an amount corresponding to the volume of the swirl chamber, a warm-up time of the engine 2 can be reduced, enabling quick warm-up, under an identical pump rotation speed (engine rotation speed) condition.

Figure 3B:
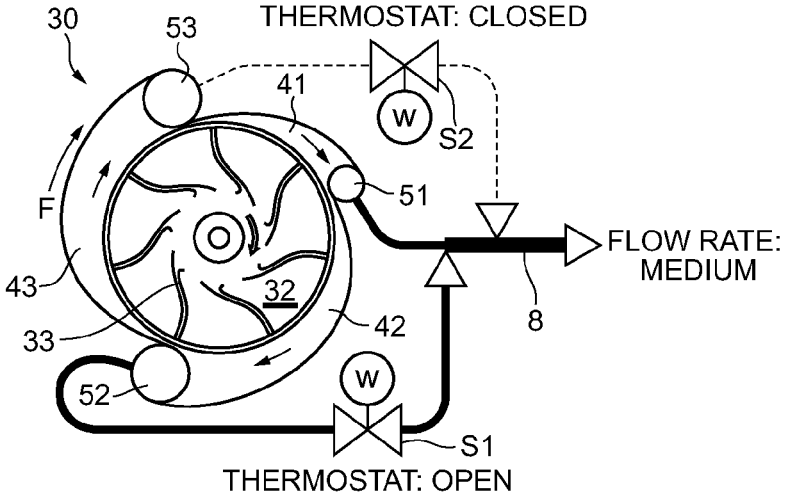
FIG. 3B shows a condition in which the coolant temperature is lower than an appropriate coolant temperature.
Figure 3C:
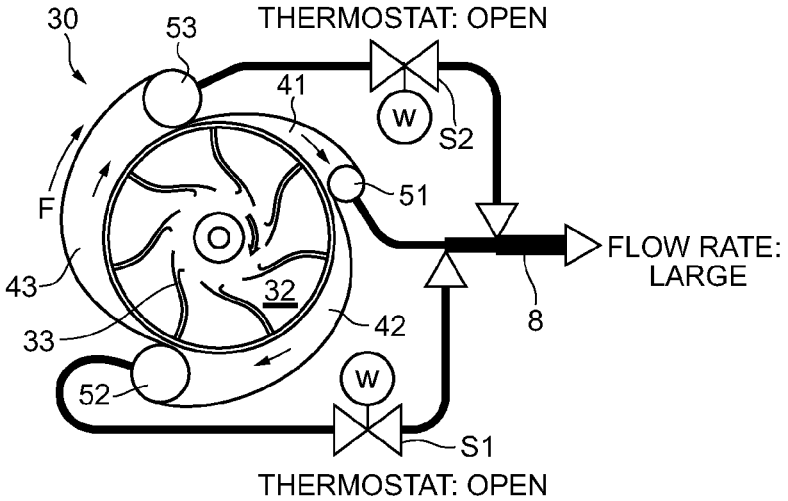
FIG. 3C shows a condition in which the coolant temperature exceeds the appropriate coolant temperature.

As warm-up of the engine 2 progresses in this condition, the flow rate at which the coolant is supplied to the engine 2 may become insufficient, causing a partial temperature increase in the engine 2, and as a result, burning or an increase in friction may occur. Therefore, at a prior stage (T1 to T2: 60° C. to 70° C.) before the coolant rises to the appropriate coolant temperature (T4: 85° C.) for the engine 2, coolant is supplied to the engine 2 from the second swirl chamber 42 in addition to the coolant from the first swirl chamber 41. More specifically, when the engine 2 is driven such that the temperature of the coolant circulating through the coolant passage increases gradually so as to exceed the predetermined first temperature T1 (60° C.), the thermostat S1 begins to open, as shown in FIG. 3B, whereby the second discharge port 52 communicates with the coolant passage 8. As the temperature of the coolant transitions from the first temperature T1 (60° C.) to the second temperature T2 (70° C.), the valve opening of the thermostat S1 increases substantially proportionately with the coolant temperature, leading to an increase in the flow rate of the coolant from the second swirl chamber 42. As a result, the coolant from the second discharge port 52, the flow rate of which increases in accordance with the valve opening of the thermostat S1, and the coolant that is discharged from the first discharge port 51 at all times at a fixed flow rate are delivered into the coolant passage 8 and supplied to the engine 2. In an environment where a heat balance is maintained in the engine 2 at the flow rate of the coolant from the first swirl chamber 41 and the second swirl chamber 42 (i.e. below a maximum capacity of the water pump 30), for example, the engine 2 can be cooled efficiently using a smaller pump workload than that of the related art.

When a heat balance is not maintained in the engine 2 and the temperature of the coolant rises further so as to exceed the third temperature T3 (75° C.), on the other hand, the other thermostat S2 begins to open such that the third discharge port 53 communicates with the coolant passage 8, and as a result, the coolant passage 8 communicates with all of the first to third discharge ports 51, 52, 53. As the temperature of the coolant transitions from the third temperature T3 (75° C.) to the fourth temperature T4 (85° C.), the valve opening of the thermostat S2 increases substantially proportionately with the coolant temperature, leading to an increase in the flow rate of the coolant from the third swirl chamber 43. As a result, the coolant from the third discharge port 53, the flow rate of which increases in accordance with the valve opening of the thermostat S2, and the coolant that is discharged from the first and second discharge ports 51, 52 at a fixed flow rate are delivered into the coolant passage 8 and supplied to the engine 2. Therefore, the engine 2 can be cooled even more effectively by the action of the coolant having the even higher flow rate.

When the temperature of the coolant reaches the fourth temperature T4 (85° C.), the valve opening of the thermostat S2 reaches a maximum, and after exceeding the appropriate coolant temperature, the coolant is discharged from the respective discharge ports 51, 52, 53 and supplied to the engine 2 at the maximum discharge flow rate of the water pump 30. In other words, an equal discharge flow rate to that of the conventional water pump is realized in this condition.

According to the water pump 30 configured as described above, when the engine 2 is started up from a cold condition, the coolant is supplied to the engine 2 at a small flow rate only from the first swirl chamber 41 that communicates with the engine 2 via the coolant passage 8 at all times, and therefore warm-up of the engine 2 can be promoted while suppressing a thermal load of the engine 2 such that the engine 2 can be warmed quickly. When the engine 2 is warm, on the other hand, the thermostats S1, S2 are opened to a valve opening corresponding to the temperature of the circulating coolant such that the coolant is supplied to the engine 2 from the second and third swirl chambers 42, 43 at a flow rate corresponding to the valve opening in addition to the coolant from the first swirl chamber 41. As a result, a sufficient engine cooling effect can be exhibited, leading to a reduction in friction in the engine 2 and a corresponding improvement in fuel efficiency, and an improvement in the thermal efficiency can be achieved, enabling a reduction in an amount of $CO_2$ discharged from the engine in exhaust gas. Further, by adjusting the discharge flow rate in steps in accordance with variation in the temperature of the coolant, coolant discharge at a flow rate exceeding the required flow rate of the engine 2 can be prevented. As a result, the workload of the water pump can be prevented from becoming excessive, and energy loss can be reduced.

A preferred embodiment of the present invention was described above, but the scope of the present invention is not limited to the above embodiment. For example, in the above embodiment, the swirl chamber 40 of the water pump 30 is divided into the first, second, and third swirl chambers, but the present invention is not limited thereto, and the swirl chamber

40 may be further divided into fourth and fifth swirl chambers. In so doing, the discharge flow rate of the water pump can be varied in more steps, enabling finer control of the flow rate.

Further, in the above embodiment, the predetermined temperatures (sensitive temperatures) at which the thermostats S1, S2 open and close are set at the first temperature T1, i.e. 60° C., and the third temperature T3, i.e. 75° C., respectively, but the present invention is not limited thereto, and the sensitive temperatures may be modified appropriately in accordance with a required cooling performance of the engine.

EXPLANATION OF NUMERALS AND CHARACTERS

1 engine cooling device
2 engine (driving means)
7 coolant passage (suction passage)
8 coolant passage (discharge passage)
30 water pump (variable flow rate pump)
31 housing
32 impeller chamber
33 impeller
40 swirl chamber
41 first swirl chamber (main swirl chamber)
42 second swirl chamber (secondary swirl chamber, divided swirl chamber)
43 third swirl chamber (secondary swirl chamber, divided swirl chamber)
S1 thermostat
S2 thermostat

The invention claimed is:

1. A variable flow rate pump provided in a coolant circulation passage to take in a coolant from a suction passage of the circulation passage and supply the coolant to a discharge passage, comprising:

a housing;

an impeller chamber formed in the housing to communicate with the suction passage;

a swirl chamber formed in the housing to communicate with the discharge passage and the impeller chamber;

an impeller supported to be free to rotate in the impeller chamber so as to take in the coolant from the suction passage and discharge the coolant into the discharge passage via the swirl chamber while rotating; and driving means for rotating the impeller, wherein the swirl chamber is formed to be divided into a main swirl chamber that communicates with the discharge passage at all times and a secondary swirl chamber that is connected to the discharge passage via a thermostat having a switch valve that can be opened and closed, the thermostat is operated to open and close, thereby connecting and cutting off the secondary swirl chamber and the discharge passage, in accordance with a temperature of coolant delivered from the secondary swirl chamber, the secondary swirl chamber is further divided to form a plurality of divided swirl chambers, a plurality of thermostats respectively having switch valves that can be opened and closed to connect and cut off the plurality of divided swirl chambers and the discharge passage in accordance with the temperature of the coolant are disposed between the plurality of divided swirl chambers and the discharge passage, and sensitive temperatures of the plurality of thermostats for connecting and cutting off the plurality of divided swirl chambers and the discharge passage are set at respectively different temperatures.

2. The variable flow rate pump according to claim 1, wherein a volume of the main swirl chamber is formed to be smaller than a volume of each of the divided swirl chambers.

* * * * *